US005169069A

United States Patent [19]

Rucker et al.

[11] Patent Number: 5,169,069

[45] Date of Patent: Dec. 8, 1992

[54] FLUID DRIVEN TANK CLEANING APPARATUS

[75] Inventors: Jon A. Rucker, Avery; Bart D. Ancheta, San Mateo; Raymond H. Brown, San Francisco, all of Calif.

[73] Assignee: Sybron Chemicals, Inc., Birmingham, N.J.

[21] Appl. No.: 628,599

[22] Filed: Dec. 17, 1990

Related U.S. Application Data

[63] Continuation-in-part of Ser. No. 504,721, Apr. 3, 1990, abandoned, which is a continuation of Ser. No. 312,214, Feb. 21, 1989, abandoned.

[51] Int. Cl.[5] ..... B05B 3/04

[52] U.S. Cl. ..... 239/227; 239/240

[58] Field of Search ..... 239/227, 240, 246, 263

[56] References Cited

U.S. PATENT DOCUMENTS

| | | | |
|---|---|---|---|
| 3,637,138 | 1/1972 | Rucker | 239/227 |
| 3,747,854 | 7/1973 | Anderson | 239/227 |
| 4,214,705 | 7/1980 | Wafts et al. | 239/227 |
| 4,347,979 | 9/1982 | Mathews | 239/240 X |
| 4,753,549 | 6/1988 | Shook et al. | 239/227 X |

*Primary Examiner*—Kevin P. Shaver
*Assistant Examiner*—Kevin P. Weldon
*Attorney, Agent, or Firm*—Cumpston & Shaw

[57] ABSTRACT

A fluid driven tank cleaning apparatus which uses part of the cleaning fluid supplied to the device for lubricating the gear train located in a separate compartment. Passageways are positioned and sized so as to maintain the separate compartment substantially filled with the cleaning solution at a relatively low pressure and flow rate therethrough. The device is constructed to minimize the corrosive effects of cleaning fluid on the moving parts.

20 Claims, 8 Drawing Sheets

FLUID DRIVEN TANK CLEANING APPARATUS

The present application is a Continuation-In-Part of application No. 07/504,721, filed Apr. 3, 1990, now abandoned, which is a Continuation of Application No. 07/312,214 filed Feb. 21, 1989, now abandoned.

The present invention relates to an apparatus for cleaning the interior surface of chambers, for example, reaction chambers, polymerization tanks, liquid storage tanks, large diameter pipes, and similar-type containers.

BACKGROUND OF THE INVENTION

Chemical, food and beverage processing industries use a variety of process, transportation, and storage vessels which must be periodically cleaned. Typically, such vessels or tanks are cleaned by a controlled spraying apparatus which uses the cleaning fluid to be sprayed within the tank to drive the nozzle spray assembly of the spraying apparatus in a predetermined pattern. These devices include a primary drive shaft which is typically driven by a turbine powered by the fluid flowing through the device. The primary drive shaft is connected to a gear train which is located in a separate compartment which is sealed from the remaining portion of the device. A lubricating fluid, such as oil, is typically placed in the separate compartment for lubricating the gear train for proper operation thereof. Appropriate seals are required for the shaft extending into the secondary chamber and for sealing the chamber from the environment. However, due to the high rotational speed of the primary drive shaft and normal wear, the seals tend to wear which results in lubricating oil leaking into the vessel and thereby contaminating the vessel. This potential leakage is a very serious problem in certain type vessels, thereby making it extremely important to minimize or prevent the leakage of such lubricating fluids into the vessel. Additionally, in many installations, the spraying apparatus is permanently or semi-permanently installed within the tank. In many of these type installations, it is extremely difficult to maintain or repair such devices. Thus, in many instances these devices are allowed to go into a state of disrepair before maintenance.

There also exist devices in the prior art which use some of the cleaning solution supplied to the device as a lubricant for the gear train. However, due to its construction, wear and durability have been a serious problem due to its vulnerability to the cleaning solution. This is particularly so because in many installations the cleaning fluid is recirculated.

Applicants have invented an improved tank cleaning device which uses part of the cleaning fluid supplied to the device as the fluid to lubricate the gear train which is designed to minimize the corrosive effects of the cleaning fluid so as to provide longer wear.

SUMMARY OF THE INVENTION

A fluid driven tank cleaning apparatus which uses part of the cleaning fluid supplied to the device for lubricating the gear train located in a separate compartment. Passageways are positioned and sized so as to maintain the separate compartment substantially filled with the cleaning solution at a relatively low pressure and flow rate there through. The device is constructed to minimize the corrosive effects of cleaning fluid on the moving parts.

DETAILED DESCRIPTION OF THE INVENTION

Figure 1:
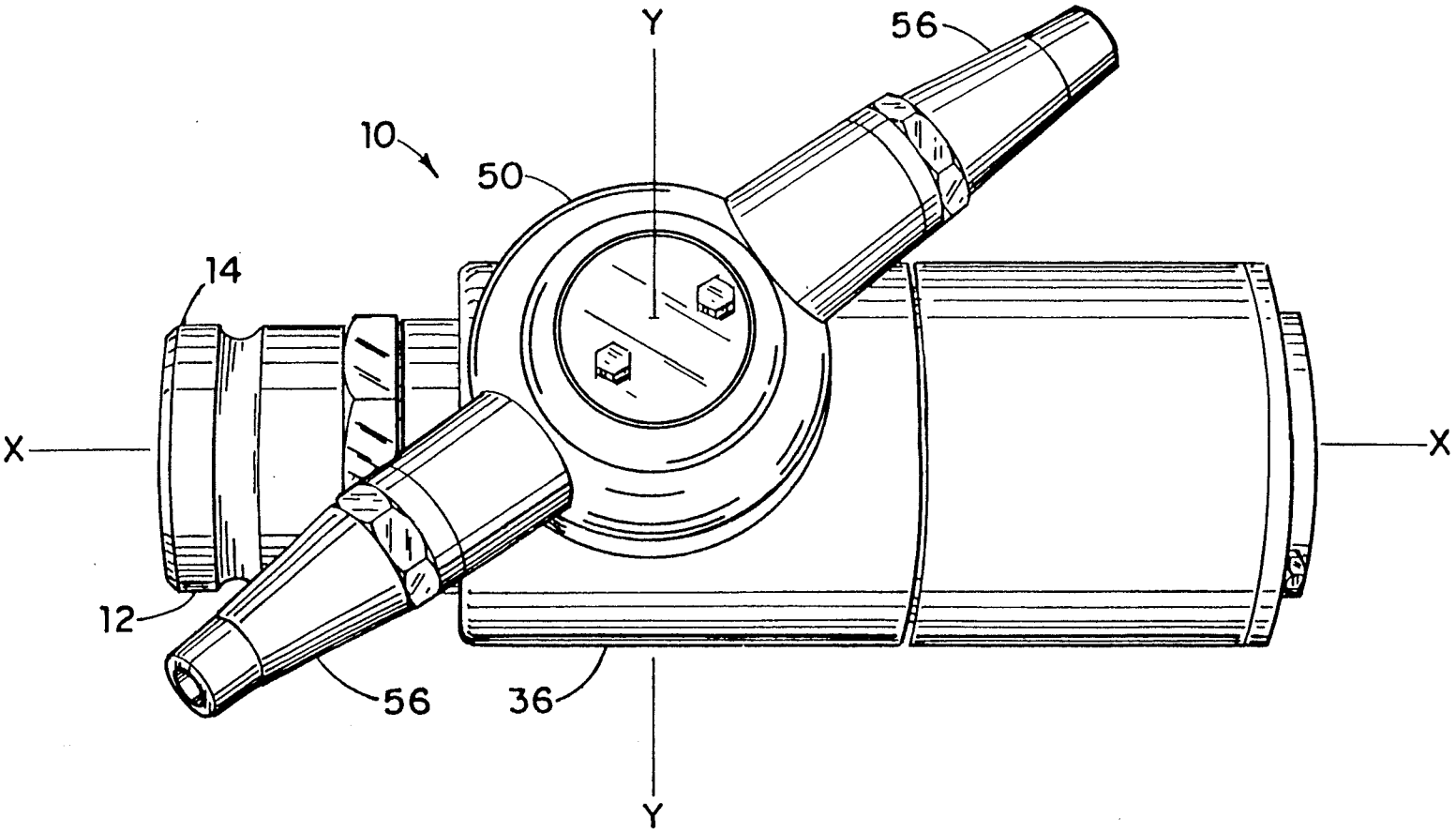
FIG. 1 illustrates a perspective view of an apparatus made in accordance with the present invention.
Figure 2:
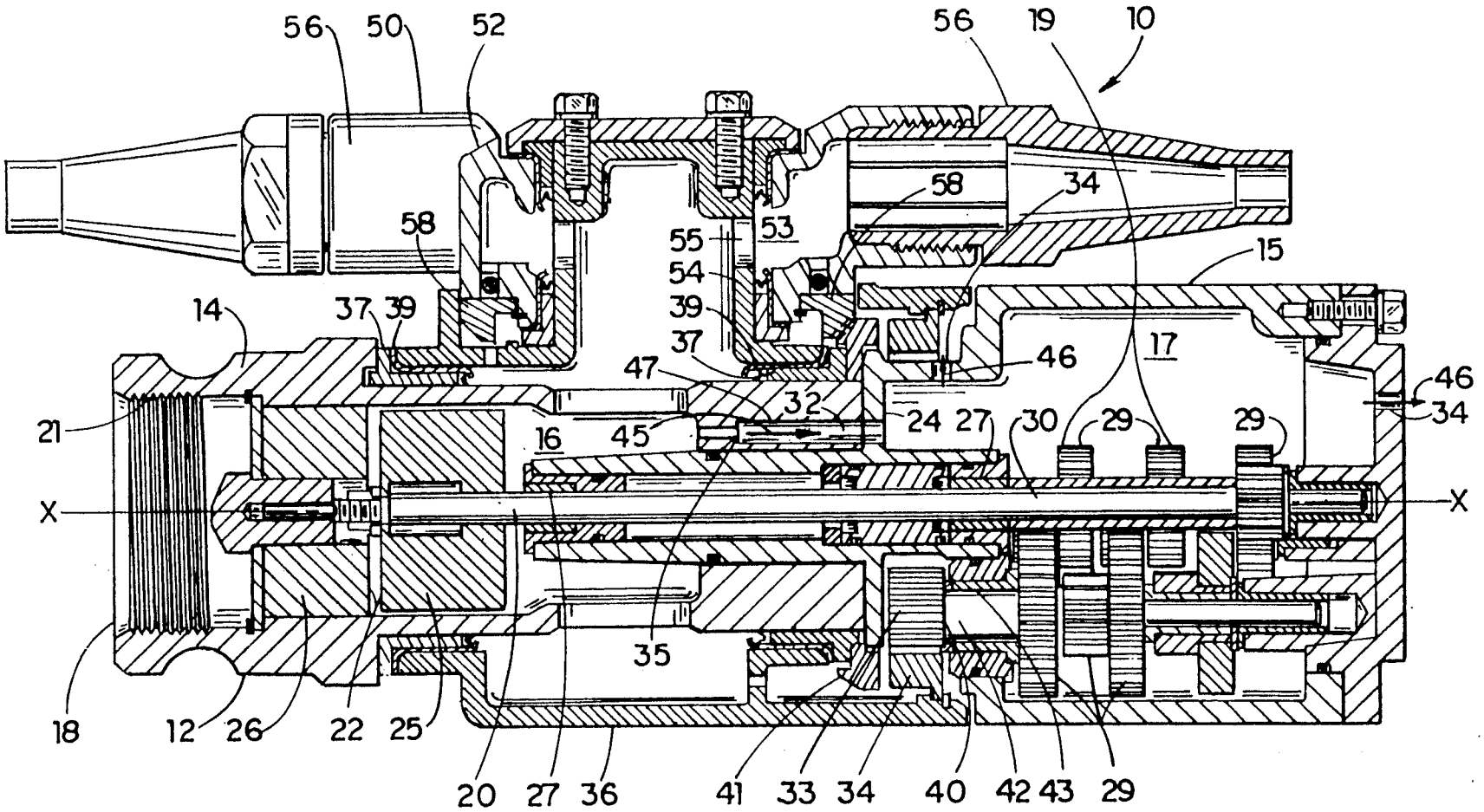
FIG. 2 is a cross sectional view taken along line X—X of FIG. 1.

Referring to FIGS. 1 and 2, there is illustrated a fluid driven tank cleaning apparatus 10, made in accordance with the present invention. The apparatus 10 includes a main housing 12 which comprises an inlet stem 14 secured to a gear train housing 15. Inlet stem 14 has an inlet 18 for connection to a source of cleaning fluid under pressure. Typically, the cleaning fluid is pressurized from about 40 to 250 psi. In the particular embodiment illustrated, the device is designed to operate at 100 to 150 psi. The inlet stem 14 is provided with internal threads 21 at inlet 18 which is capable of being connected to an appropriate coupling (not shown) having a corresponding male threaded section. It is, of course, understood that the inlet stem 14 may be connected in any desired manner to any suitable source of cleaning fluid. The inlet 18 is fluidly connected to receiving chamber 16 formed in inlet stem 14. The housing 12 is further provided with a secondary chamber 17 in gear train housing 15 which is separated from receiving chamber 16 by common wall 24. A gear train 19 is provided in secondary chamber 17 which is used to drive certain other parts of the tank cleaning apparatus as will be later described herein.

Rotatably mounted within receiving chamber 16 is a primary drive shaft 20. The rearward end 30 of primary drive shaft 20 extends through common wall 24 into chamber 17. Located at the forward end of receiving chamber 16 adjacent inlet 18 is drive means 22 for rotating primary drive shaft 20 in response to fluid entering housing 12. In the particular embodiment illustrated, drive means 22 is a turbine which includes a rotor 25 and stator 26. The stator 26 is secured to inlet stem 14 in inlet 18. Rotor 25 is positioned adjacent to stator 26 and is secured to the primary shaft for rotation therewith. The shaft 20 is rotatably mounted to housing 12 by bearings or bushings 27 located in gear train housing 15. Fluxes pressure enters through inlet 18 and passes through stator 26 and rotor 25. This causes the rotor 25 to rotate and thus, in turn, causes the primary shaft 20 to rotate about axis X—X. The rearward end 30 of primary drive shaft 20 is disposed in secondary chamber 17, and is used to drive gear train 19 which is also mounted in secondary chamber 17. Gear train 19 includes an output shaft 32 which is connected to primary shaft 20 by an appropriate number of gears 29 mounted to housing 15. Gear train 19 is used to reduce the rotational speed of output shaft 32 to a desired RPM. It is to be understood that the gears 29 of gear train 19 are selected and arranged so as to provide any desired output rotational speed to output shaft 32.

The apparatus 10 further includes a Tee-housing 36 which is rotatably mounted to housing 12 by a pair of bushings or bearings 37 and adjacent seals 39 for rotation about longitudinal axis X—X. The outward end 40 of output shaft 42 has a pinion gear 33 secured thereto for driving spur gear 34 which is secured to Tee-housing 36. Rotation of spur gear 34 causes ,Tee-housing 36 to rotate about housing 12. A drive bevel gear 41 is secured to gear train housing 15.

Apparatus 10 further includes a nozzle carrier assembly 50 which is rotatably mounted to Tee-housing 36 which includes a body 52 which forms receiving chamber 53 for receiving a liquid directly from nose section 54 of Tee-housing 36 through opening 55 in nose section 54 which is in direct fluid communication with receiving chamber 16. At least one spray nozzle 56 is rotatably mounted to body 52 for rotation about axis Y—Y of Tee-housing 36 for spraying a cleaning fluid liquid against the inside of a tank. In the embodiment illustrated, two fluid spray nozzles 56 are provided. It is to be understood that the nozzle carrier assembly 50 is typical of prior art devices, and may take a variety of other forms and shapes as presently exist, or may be developed in the future. The nozzle assembly 50 further includes a driven bevel gear 58 which is designed to engage drive bevel gear 41 secured to gear train housing 15.

The secondary chamber 17 is provided with a communication passageway 32 for allowing flow of cleaning fluid from chamber 16 into chamber 17 as indicated by arrow 45. The secondary chamber 17 is further provided with at least one outlet passageway 34 for allowing cleaning fluid in secondary chamber 17 to exit therefrom as indicated by arrow 46. In the particular embodiment illustrated two outlet passageways 34 are provided. The cross-sectional area of connecting passageway 32 and outlet passageways 34 are such that the fluid pressure within secondary chamber 17 is kept to a relatively low pressure level and the amount of flow of cleaning fluid through secondary chamber 17 is small. The fluid pressure within secondary chamber 17 need only be sufficiently high so as to maintain the gear train housing 15 substantially filled with cleaning solution. Applicants have found that pressures equal to or less than about 15 psi in the secondary are believed to be detrimental to gear train 19. Passageways 32 and 34 are located to assure that a full level of cleaning fluid is maintained in secondary chamber 17. Apparatus 10 may be positioned in the vertical inlet of the tank to be cleaned in an up, down, or horizontal position for cleaning. Outlet passageways 34 are preferably located opposite passageway 32. The fluid flow through secondary chamber 17 is kept to a minimum so as to minimize or avoid excess deposit built up in chamber 17 and/or clogging of passageways 32, 34. In the particular embodiment illustrated the cross-sectional size of passageways 32 and 34 are designed such that the fluid pressure in secondary chamber 17 is about 10 psi and a fluid rate through secondary chambers 17 is no greater than about 1-2 gallons per minute. In the particular embodiment illustrated the passageway 32 comprises a cylindrical bore having a diameter of about 0.120 inches and the outlet passageways 34 each comprise a bore having a diameter D1 of 0.160 inches. Preferably the cross-sectional access of connecting passageway 32 is less than the total cross-sectional area of outlet passageway 34. It is, of course, understood that the size of the passageways 32, 34 may be varied in accordance with the pressure and flow rate of the cleaning fluid present in the main receiving chamber 16. To further minimize deposit build up in passageways 32, 34, the passageways 32, 34 are preferably designed such that they slightly increase in cross-sectional width. For example, passageway 32 has a diameter of 0.120 inches adjacent receiving chamber 16 and increases to a diameter of about 0.140 at point 35. This increase in diameter of the embodiment illustrated is formed by counter bore 47. This slight increase in width of passageway 32 minimizes clogging due to suspended particles typically found in the cleaning solution which is often recirculated.

The cleaning solution that flows into the secondary chamber 17 provides a useful function of cooling and lubricating, at least to a certain extent, the gears, 39 to a sufficient degree to minimize any undue wear and eliminate the need to use a lubricating oil. Typically, the cleaning fluid that is supplied to receiving chamber 16 is of a potentially corrosive nature with regard to the gear train 19 and other parts of the apparatus. Examples of various cleaning fluids that may be used are sodium hydroxide or a solvent/surfactant. It is, of course, understood that any desired cleaning fluid may be used. Thus, it is important that the device be designed to be used in this harsh environment. Applicants have found that in order to provide a gear train 19 that is durable and resistant to the corrosive nature of the cleaning fluid that may be used in the device,,the bearings used for rotation of primary shaft 20 and outlet shaft 42 are preferably designed to be corrosion resistant. In the particular embodiment illustrated, bearings 27, 43 are made of a filled Teflon material. Applicants have found that the use of too soft a material does not provide satisfactory performance due to its high wear rate. Thus the use of a bearing made of pure Teflon is not suitable. In the particular embodiment illustrated, bearings 27, 43 are made of glass filled Teflon. Applicant have found that the use of glass filled Teflon, sold under the trademark Fluorogold by Fluorocarbon, performs quite suitably for bearings 27 and 43. Applicants have also found that tungsten carbide bearings work quite satisfactorily for bearings 27,43. The gears 29 must also have a sufficient amount of strength for transmission of the applied forces and maintain acceptable wear properties while also being resistant to the corrosive effects of the cleaning solution. Applicants have found that gears made of 416 stainless steel work quite satisfactorily. Because Teflon bearings 27, 43 are used, alignment of meshing gears 29 may become more critical. As the parts start to wear, increased misalignment may occur which may result in increased wear or locking up of the gears. To minimize the effect of potential misalignment, gears 29 are straight cut spur gears.

Figure 3:
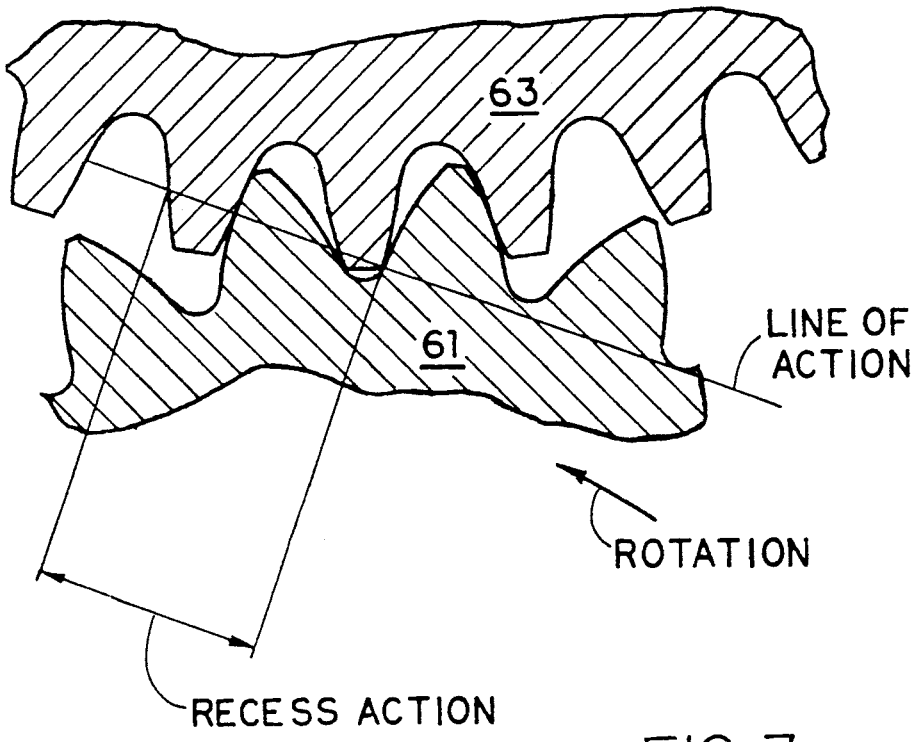
FIG. 3 is an enlarged, partial, side view of the gear teeth of two meshing gears illustrated in FIG. 2.

In order to further improve the wear resistance of gears 29, the gears 29 are preferably designed to be of the recess action type. For the purpose of the present invention, the term "recess action gears" is used for any gears where the amount of recess action is substantially more than the amount of approach action. Referring to FIG. 3, there is illustrated an enlarged fragmentary side view of recess action gears that are commonly available and would be suitable for use as gears 29. Gear 61 is the drive gear and gear 63 is the driven gear. Preferably full recess action gears are used as illustrated in FIG. 3, however, semi-recess action gears may also be used. In addition to the improved wear characteristic of recess action gears, these type of gears allow the die casting of the gears which results in lower manufacturing costs. Cast recess action gears tend to improve with use and are believed to be preferred in the subject device.

In order to more fully understand the present invention, a brief description of the operation of apparatus 10 will be discussed. A fluid under pressure enters inlet stem 14 and passes through stator 26 and rotor 25. This fluid flow causes rotor 25 to rotate, thus causing primary shaft 20 to also rotate about longitudinal axis X—X. The primary drive shaft 20 rotates so as to drive gear train 19 and output shaft 42, which in turn causes pinion gear 33 to drive spur gear 34, causing Tee-housing 36 to rotate about axis X—X. The drive bevel gear 41, which is secured to gear train housing 15 engages driven bevel gear 58 on carrier assembly 50 through an opening in Tee-housing 36 causing the carrier assembly to rotate about axis Y—Y. Fluid is caused to be passed from the receiving chamber through the appropriate passageway and through nozzles 56. At the same time, fluid in receiving chamber 16 flows through communication passageway 32, filling secondary chamber 17 up with cleaning fluid. Once the secondary chamber 17 has been filled with the cleaning fluid, a fluid pressure will build up within secondary chamber 17, causing fluid to exit passageways 34. This results in a small continuous flow of fluid flowing through secondary chamber 17. As previously discussed, the pressure and fluid flow in chamber 17 is kept below certain prescribed limits as desired.

Referring to FIGS. 4–8 there is illustrated a cross-sectional view of a modified apparatus 110 made in accordance with the present invention. The apparatus 110 is similar to apparatus 10, like numerals indicating like parts. The gear train has been removed from the drawing for purposes of clarity. In this embodiment, means have been provided for allowing quick, easy and economical changing of the size and configuration of the inlet and outlet openings 32, 34 In the particular embodiment illustrated, opening 32 is sized so as to receive a plug insert 70. The plug insert 70 is provided with an outer threaded surface 72 which is designed to engage internal thread 74 in opening 32 such that when the plug insert 70 is threaded into opening 32, the insert 70 will form a fluid sealing relationship. Preferably, as illustrated, insert 70 is provided with NPT tapered threads to prevent and/or minimize leaks therethrough.

Figure 6:
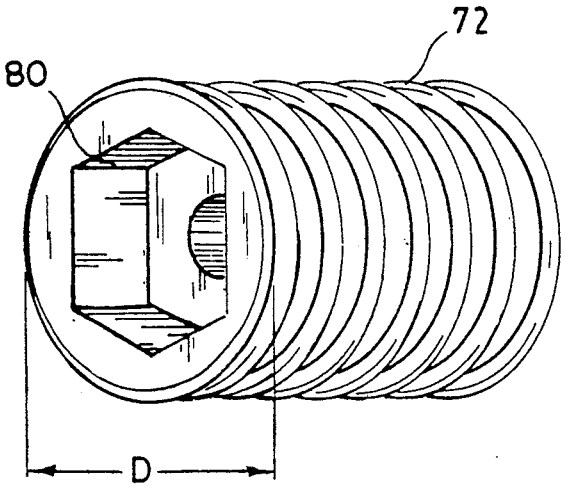
FIG. 6 is a perspective view of the insert illustrated in FIG. 5.
Figure 7:
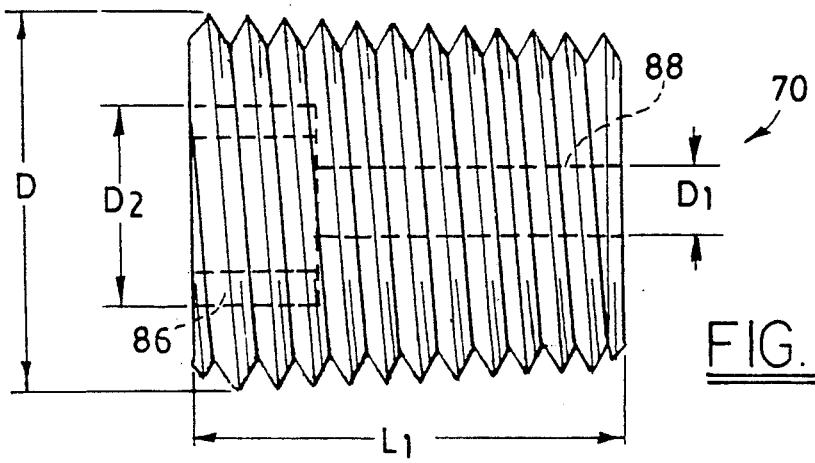
FIG. 7 is a side elevational view of the insert of FIG. 6.
Figure 8:
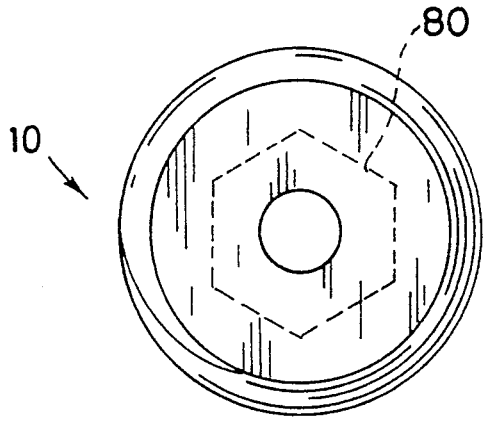
FIG. 8 is a rear end elevational view of the insert of FIG. 6.

The plug insert 70 is provided with an internal passageway 76. Passageway 76 has a narrow section 78 adjacent to the pressure inlet chamber which comprises a cylindrical bore having a diameter D1. Passageway 76 is also provided with a wide section 80 adjacent narrow section 78, the cross-sectional area of wide portion 80 is preferably substantially greater than that of narrow section 78. The wide section 80 provides two function; first, it increases the cross-sectional area of passageway 76 in the same way that counter bore 47 increases the cross-sectional area of passageway 32 of the embodiment of FIGS. 1–3. In the particular embodiment illustrated, the plug insert 70 has a length L, and outer diameter D of about 0.40 inches (1.016 cm). It is, of course, to be understood that the diameter D may be varied to accommodate any desired size threaded openings 32 in which the plug insert 70 is are to be placed. The material is selected so as to provide the desired flow characteristics through the plug insert 70. In the particular embodiment illustrated, the plug insert 70 has a length L, of about 0.280 inches (0.7112 cm) and a diameter D1 in narrow section 78 of about 0.060 inches (0.152 cm). Wide section 80 of plug insert 70 in the particular embodiment illustrated is hexagonal in cross-sectional configuration as is best seen in FIGS. 6 and 8 and has a width D2 across the flats of about 0.190 inches (0.483 cm). The hexagonal configuration of wide section 80 provides means for inserting and removing the insert plug 70 in opening 32. Typically, an appropriately sized hexagonal wrench is placed in wide section 80 such that it can rotate insert plug 70 within opening 32 so as to properly seat the insert plug in opening 32. Preferably, insert 70 is made of a non-corrosive steel.

Figure 9:
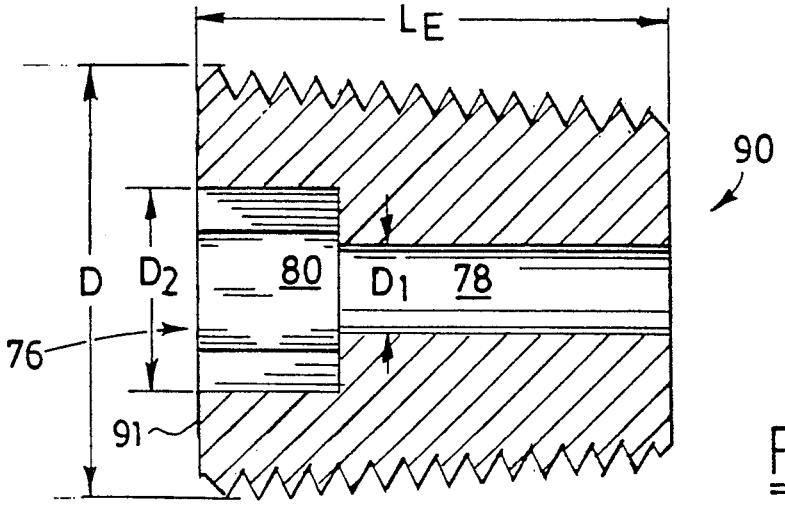
FIG. 9 is an enlarged cross-sectional view showing an insert placed in passageway 34.
Figure 10:
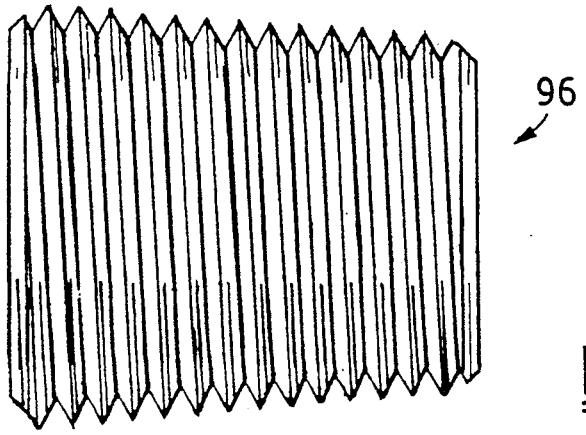
FIG. 10 is a side elevational view of the insert of FIG. 9.

Much in the same manner as passageway 32 is provided with a plug insert 70, passageways 34 are each provided with an insert 90. The inserts 90 are similar to insert 70, like numerals representing like parts. The insert 90 is different from insert 70 generally in the size of the passageway 76. Either may be modified to the desired size so as to provide the desired flow rate through the gear box chamber. Referring to FIG. 9, in the embodiment illustrated diameter D1 of insert 90 is about 0.156 inches (0.396 cm) and width D2 is about 0.190 inches (0.483 cm). Insert 90, like insert 70, is preferably provided with NPT tapered threads to prevent and/or minimize leaks.

The inserts 70 and 90 are preferably designed such that they may be threadedly engaged into the corresponding openings 32 and 34, respectively, in an easy and convenient manner. In the particular embodiment illustrated, the insert 70 is threadedly engaged in the wall 24 of the gearbox housing.. This may be simply accomplished by removing the end cap 57 from gear housing 15 by removing securing. The insert 90 in passageway 34 located in end plate 59 may be threadedly engaged on either side of the plate desired so long as the appropriate narrow passageway is provided therein. Preferably, the insert 90 in end plate 59 is inserted from the outside so that it can be easily removed from the outside of the drive. With respect to the opening 34, which is adjacent the passageway 32, it is preferred that the insert 90 is threadedly engaged from the outside of the casing such that the top 91 of the insert 90 extends below the outer surface of the gearbox housing 15 to avoid any potential conflict with the rotating nozzle.

Inserts 70 and 90 provide a large latitude to the user with respect to being able to adjust the flow characteristics of the fluid within the gear chamber thus allowing apparatus 110 to meet the various operating conditions under which it is to be operated. For example, depending upon the fluid medium that is to be used within the device and the pressure at which the fluid is supplied, various combinations of sizes for passageway 76 in inserts 70 and 90 may be provided so as to provide the desired fluid flow rate through the gearbox. In addition to being able to adjust the size of the openings in insert plugs 70, 90, the configuration of the passages may be modified to any desired configuration to provide any other flow characteristics that may be desired. For example, but not by way of limitation, passageway 76 may be conical in cross-sectional shape.

Figure 11:
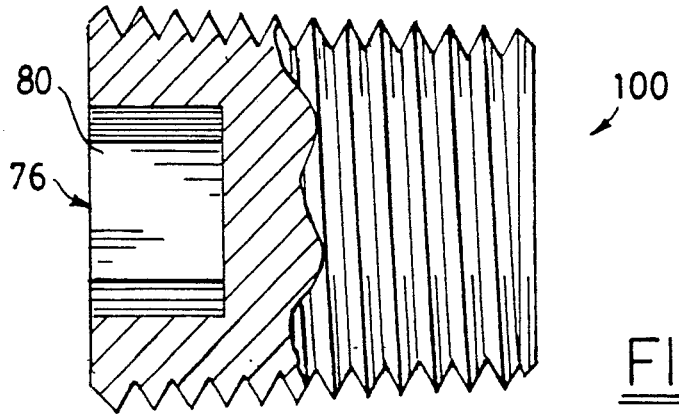
FIG. 11 is a perspective view of an insert designed for placement in either passageway 32 or 34 which does not have any internal passageway.

The use of the plug insert 70,90 further provides the ability to be able to easily convert the device from a flow through type device to a fully lubricated gearbox device or vice versa if is so desired. This allows the manufacturer to use a single cast gearbox 15 for a variety of different configured devices which reduces manufacturing costs and allows the user to be able to fully adjust and modify the device to meet the current cleaning condition. This also allows versatility in using the device in totally different environments with a minimal amount of cost in modifications and labor. When it is desired to operate the gearbox 15 in a lubricated condition, a plug 100, such as illustrated in FIG. 11 may be provided within passageways 32 and 34 so as to provide a sealed fluid gearbox chamber 17. Plug 100 is similar to plug inserts 70 and 90, like numerals indicting like parts, except passageway 76 does not extend through the plug 100. Instead only wide portion 80 is provided to allow for the inserting and removing plug insert 100. Additionally, by providing the insert 100 in end cover 59 such that it is threaded from the outside of the end cover 59, this allows checking of the fluids within the gearbox chamber without having to remove the entire device or remove the entire cover. The plug 100 is simply removed by unthreading the insert to allow inspection and is then rethreaded when completed. This avoids the necessity of removing the end plate and any appropriate seals therewith.

Figure 4:
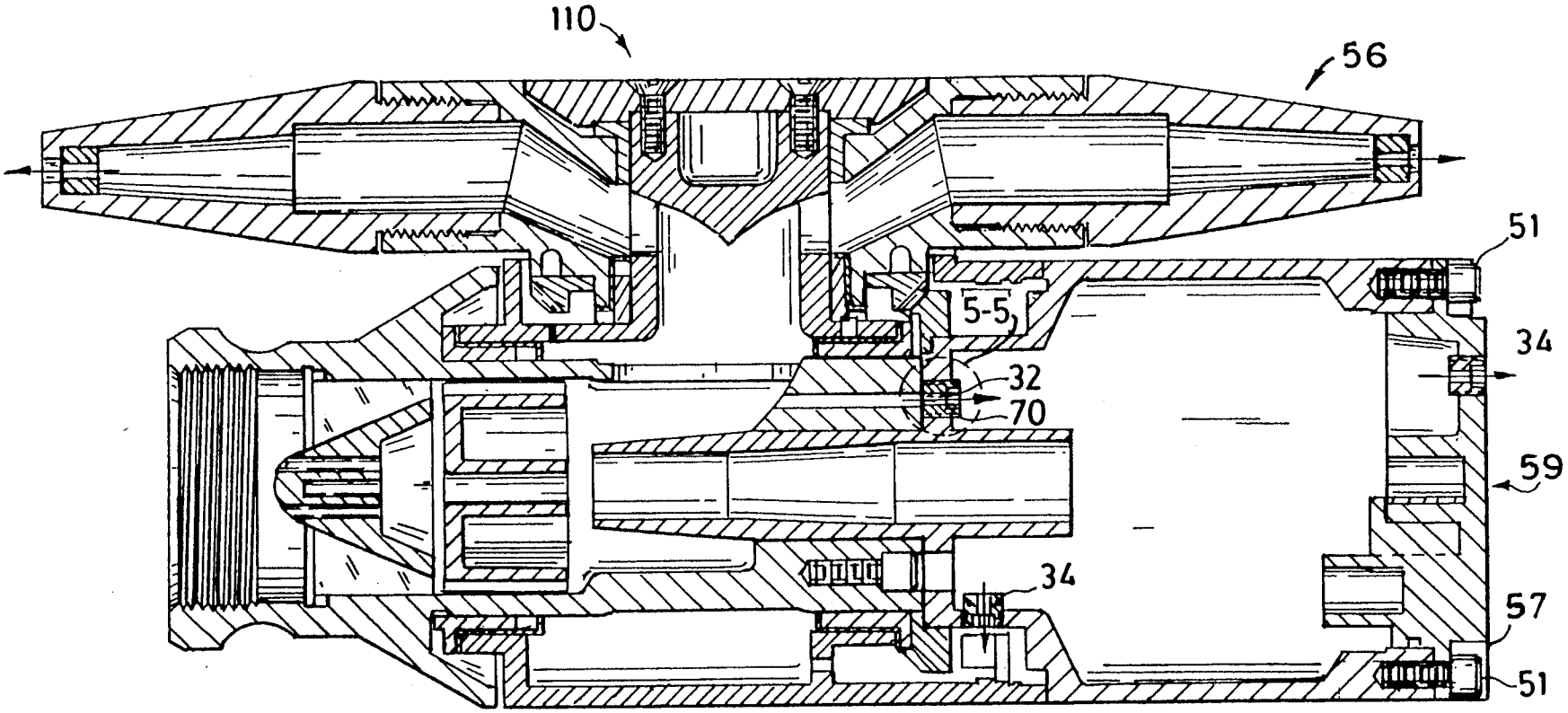
FIG. 4 is a cross-sectional view of modified apparatus made in accordance with the present invention.
Figure 5:
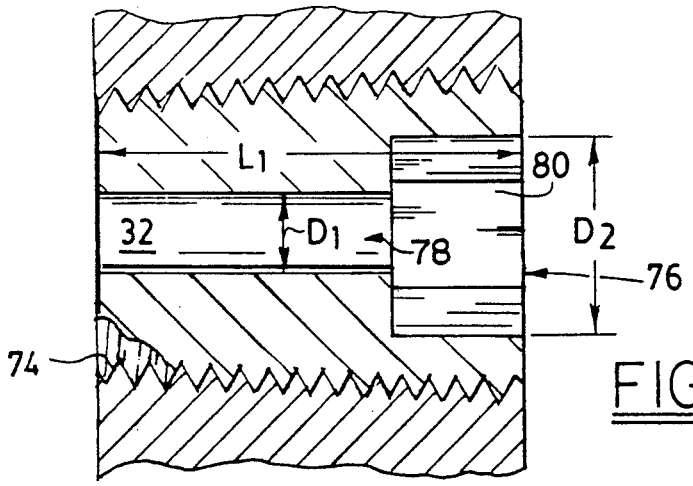
FIG. 5 is a enlarged cross-sectional view of a portion of the device as illustrated by line 5—5 of FIG. 4 illustrating an insert placed in passageway.
Figure 12:
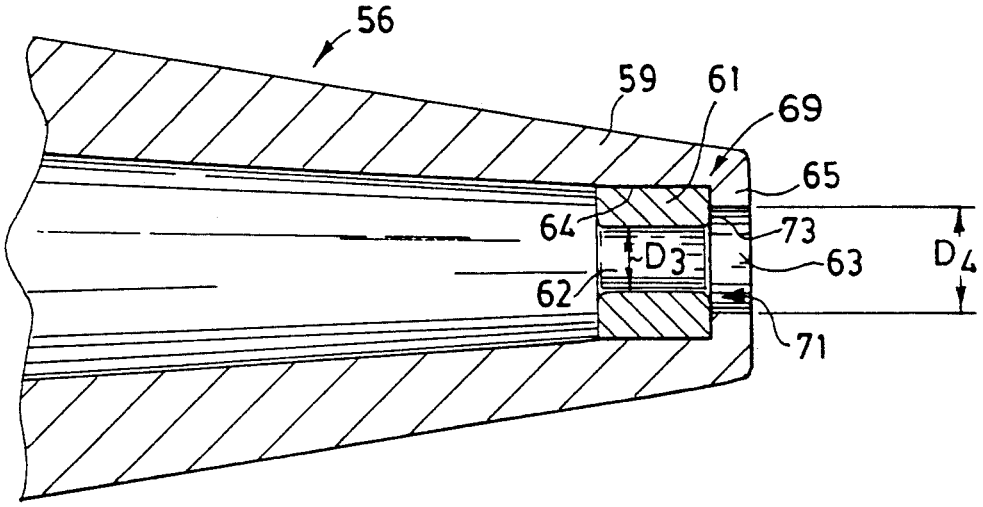
FIG. 12 is an enlarged cross-sectional view of the nozzle assembly of the modified device of FIG. 4.
Figure 13:
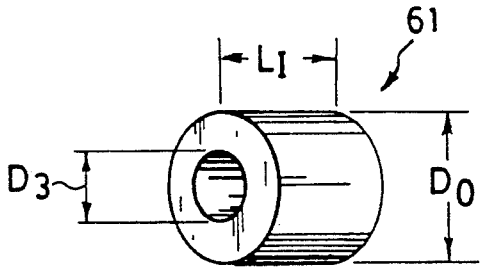
FIG. 13 is an enlarged cross-sectional view of the tip portion of the nozzle of FIG. 12 illustrating the replaceable inserts placed therein.

Referring to FIGS. 12 and 13, there is illustrated an enlarged partial cross-sectional view of the tip portion 59 of the nozzle 56 of FIG. 4 which is designed to receive a removal insert 61 adjacent an opening 63 to allow fluid to pass out the end of the nozzle 56. The tip parts 59 of nozzle 56 is provided with a annular lip 65 which forms opening 63. The insert 61 is designed so to butt up against the inside surface of lip 65. The insert 61 has an opening 62 for allowing fluid to pass through nozzle 56. The opening 62 of insert 61 as a diameter D3 which is designed to be smaller than the size of opening 63 which has a diameter D4. The annular receiving section 69 behind the lip 65 is designed to have a configuration that corresponds to the outer configuration of the insert 61. Preferably, the inside diameter $D_I$ of section 69 is slightly smaller than the outside diameter $D_o$ of insert 61 so as to provide a friction fit. Only a sufficient amount of force is necessary to prevent the insert from falling out of the receiving section 69. When it is desired to remove insert 61, the insert 61 is simply pushed in the direction opposite as indicated by arrow 71 by the insertion of a tool through opening 63 so as to press against the outer surface 73 of insert 61. In this manner various configured inserts having the desired diameter D3 for opening 62 may be placed in nozzle tip 59 to control the fluid flow through the nozzle 56. In the particular embodiment illustrated, insert 61 has a length L1 of about 0.5 inches (1.27 cm), a diameter $D_o$ of about 0.407 inches (1.03 cm) and a diameter D3 of about 0.18 inches (0.457 cm). The present invention allows the device to be easily and economically modified so as to allow adjustment of the fluid flow rate through the nozzle 56 by proper selection of the diameter D3 of opening 62, in response to the fluid supply conditions. Thus, the device may be modified to be operated as a high or low pressure device with high or low flow rates. The insert 61 is preferably made of a material which produces good flow characteristics through opening 62. In the preferred embodiment, insert 61 is made of tungsten carbide.

Figure 14:
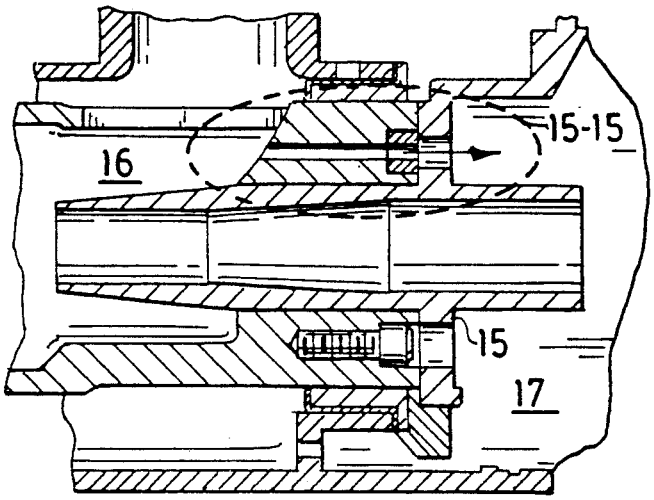
FIG. 14 is a partial cross-sectional view of another modified apparatus made in accordance with the present invention illustrating an alternate method for controlling the size of the passage into the gear box chamber.
Figure 15:
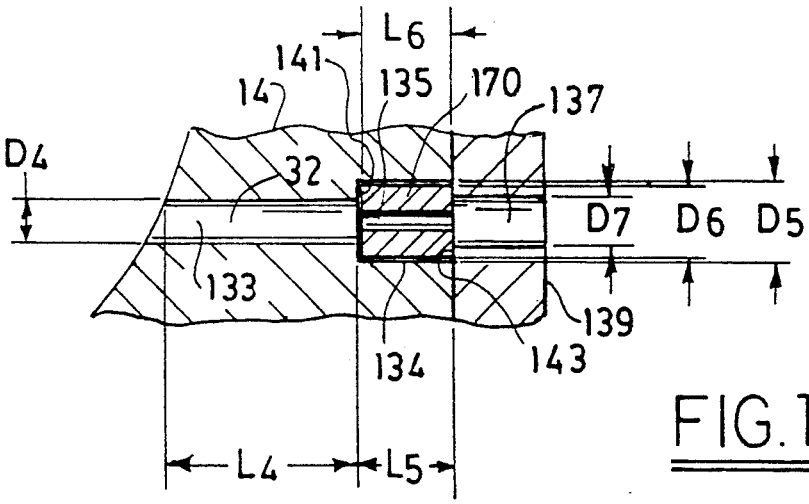
FIG. 15 is an enlarged cross-sectional view of FIG. 14 as taken along line 15—15, illustrating the apparatus in greater detail.

Referring to FIGS. 14 and 15 there is illustrated another modified apparatus made in accordance with the present invention. This apparatus is similar to that illustrated in FIG. 4, like numerals indicting like parts except that the insert 170 is held in place by means other than the external threads previously discussed with respect to insert 70. In this embodiment, insert 170 is held in position by the configuration of gear train housing 15 and inlet stem 14. Passageway 32 in inlet stem has a first narrow cylindrical section 133 having a diameter D4 and length L4 adjacent the receiving chamber 16 and a wide cylindrical section 134 having a diameter D5 and length L5. The diameter D5 and length L5 of wide section is sized so as to receive insert plug 170 having a diameter D6 and length L6 designed so that insert 170 can be easily inserted and removed from wide cylindrical section 134. The diameter D4 is less than diameter D6 of insert plug 170 so as to provide an annular shoulder 141 against which the insert plug 170 is prevented from further movement. The insert 170 has a cylindrical passage 135 which extends therethrough to provide fluid communication to chamber 17 of gear train housing 14 through circular opening 137 in wall 139 of gear train housing 14. Opening 137 has a diameter D7 which is greater than passage 135 but smaller than outside diameter D6 of insert plug 170 so as to provide a circular shoulder 143 to prevent insert plug 170 from moving out of wide section 134 when the device is assembled. This method of retaining plug insert 170 is relatively easy to manufacture and assemble and avoids the necessity of threading the gear box for receiving the insert plug.

It is to be understood that various other modifications and changes may be made to the present invention without departing from the scope of the present invention. The following claims define the scope of the present invention.

What is claimed is:

1. A fluid driven tank cleaning apparatus comprising:

a housing having a fluid receiving chamber, an inlet for connecting said receiving chamber to a source of a cleaning fluid under pressure, and a secondary chamber separated from said receiving chamber by a common wall;

a primary drive shaft rotatably mounted within said receiving chamber and extending into said secondary chamber;

drive means connected to said primary drive shaft and disposed within said inlet for rotating said primary drive shaft in response to fluid entering said housing;

gear reduction means disposed in said secondary chamber and connected to said primary shaft for reducing the rotational speed of said primary drive shaft, said gear reduction means includes a plurality of gears made of a material resistant to corrosion and cleaning solutions;

said housing having a fluid connecting passageway between said receiving chamber and said secondary chamber and at least one outlet passageway in said secondary chamber for allowing fluid to exit from said secondary chamber so as to provide low pressure fluid in said secondary chamber and maintain said secondary chamber substantially filled with said cleaning fluid; and an output shaft rotatably mounted within said secondary chamber and connected to said primary shaft through said gear reduction means, said output shaft and plurality of gears being rotatably mounted by bearings made of a material resistant to corrosive effect of said cleaning fluid.

2. A fluid driven tank cleaning apparatus according to claim 1 wherein said connecting passageway and said at least one outlet passageway being sized such that the fluid pressure within secondary chamber is no greater than about 10 psi.

3. A fluid driven tank cleaning apparatus according to claim 1 wherein said plurality gears are made of 303 stainless steel.

4. A fluid driven tank cleaning apparatus according to claim 1 wherein said bearings are made of a filled Teflon material.

5. A fluid driven tank cleaning apparatus according to claim 1 wherein said passageway between said receiving chamber and secondary chamber increases in cross-sectional area so as to minimize clogging thereof.

6. A fluid driven tank cleaning device according to claim 1 wherein said gears are of the recess action type.

7. A fluid driven tank cleaning apparatus comprising: a housing having a fluid receiving chamber, an inlet for connecting said receiving chamber to a source of a cleaning fluid under pressure, and a secondary chamber separated from said receiving chamber by a common wall;

a primary drive shaft rotatably mounted within said receiving, chamber and extending into said secondary chamber;

drive means connected to said primary drive shaft and disposed within said inlet for rotating said primary drive shaft in response to fluid entering said housing;

gear reduction means disposed in said secondary chamber and connected to said primary shaft for reducing the rotational speed of said primary drive shaft, said gear reduction means includes a plurality of gears made of the recess action type;

said housing having a fluid connecting passageway between said receiving chamber and said secondary chamber and at least one outlet passageway in said secondary chamber for allowing fluid to exit from said secondary chamber so as to provide low pressure fluid in said secondary chamber and maintain said secondary chamber substantially filled with said cleaning fluid; and;

an output shaft rotatably mounted within said secondary chamber and connected to said primary shaft through said gear reduction means.

8. A fluid driven tank cleaning device according to claim 7 wherein said output shaft and plurality of gears being rotatably mounted by bearings made of a material resistant to corrosive effect of said cleaning fluid.

9. A fluid driven tank cleaning apparatus according to claim 7 wherein said connecting passageway and said at least one outlet passageway being sized such that the fluid pressure within secondary chamber is no greater than about 10 psi.

10. A fluid driven tank cleaning apparatus according to claim 7 wherein said plurality gears are made of 303 stainless steel.

11. A fluid driven tank cleaning apparatus according to claim 7 wherein said bearings are made of a filled Teflon material.

12. A fluid driven tank cleaning apparatus according to claim 7 wherein said passageway between said receiving chamber and secondary chamber increase in cross-sectional area so as to minimize clogging thereof.

13. A fluid driven tank cleaning apparatus comprising:

a housing having fluid receiving chamber, an inlet for connecting said receiving chamber to a source of like cleaning fluid under pressure, and a secondary chamber separated to receiving chamber by a common wall;

a primary drive shaft rotatably mounted within said receiving chamber and extending into said secondary chamber;

drive means connected to said primary drive shaft and disposed within said inlet for rotating said primary drive shaft in response to fluid entering said housing;

gear reduction means disposed in said secondary chamber and connected to said primary shaft for reducing a rotational speed of said primary drive shaft, said gear reduction means includes a plurality of gears;

an output shaft rotatably mounted within said secondary chamber and connected to said primary shaft to said gear reduction means;

said common wall separating said receiving secondary chamber having a passageway formed therethrough for allowing fluid to pass therethrough, said housing having at least one outlet passageway capable of allowing fluid to flow out of said secondary chamber;

means for controlling the rate of flow of fluid through said secondary chamber, said means comprising an insert having a fluid flow passage therethrough, said insert designed to be threadedly engaged within said passageway in said common wall and said at least one outlet passageway

14. A fluid driven tank cleaning apparatus according to claim 13 wherein said fluid passage of said insert comprises a first narrow section and an adjacent wide section.

15. A fluid drive tank cleaning apparatus according to claim 13 wherein said insert is provided with means for allowing positive engagement of said inert so that said insert be threaded within said passageway in said common wall and said insert at least one outlet passageway.

16. A fluid drive tank cleaning apparatus according to claim 14 wherein said insert is provided with means for allowing positive engagement of said inert so that said insert be threaded within said passageway in said common wall and said insert at least one outlet passageway.

17. A fluid driven tank cleaning apparatus according to claim 16 wherein said means for positive engagement comprises said wide section of said fluid flow passage having a cross-sectional configuration designed to lock with as mating tool.

18. A fluid driven device according to claim 18 wherein said cross-sectional configuration is hexagonal.

19. A fluid driven tank cleaning apparatus comprising:

a housing having fluid receiving chamber, an inlet stem for connecting said receiving chamber to a source of like cleaning fluid under pressure, and a gear train housing having secondary chamber separated from said receiving chamber by a common wall;

a primary drive shaft rotatably mounted within said receiving chamber and extending into said secondary chamber;

drive means connected to said primary drive shaft and disposed within said inlet for rotating said primary drive shaft in response to fluid entering said housing;

gear reduction means disposed in said secondary chamber and connected to said primary shaft for reducing a rotational speed of said primary drive shaft, said gear reduction means includes a plurality of gears;

an output shaft rotatably mounted within said secondary chamber and connected to said primary shaft to said gear reduction means;

said common wall separating said receiving secondary chamber having a passageway formed therethrough for allowing fluid to pass therethrough, said inlet stem having a passageway in fluid communication with a said passageway formed in said common wall, said housing having at least one outlet passageway capable of allowing fluid to flow out of said secondary chamber;

means for controlling the rate of flow of fluid through said secondary chamber, said means comprising an insert having a fluid flow passage therethrough;

means for receiving said insert within said passageway in said inlet stem and second means for securing said insert in said at least, one outlet passageway.

20. A fluid driven tank cleaning apparatus according to claim 19 wherein said means for receiving said insert within said passageway in said inlet stem comprises said fluid passage of said inlet stem having a first narrow section and an adjacent wide section, said wide section having a diameter capable of receiving the outer diameter of said insert, said first narrow section having a diameter smaller than the outer diameter of said insert so as to form a retention shoulder against which said insert can rest, said opening in said common wall having a diameter smaller than said outer diameter of said insert so that insert wall be captured within said wide section when said device is assembled.

* * * * *